US009115959B2

(12) United States Patent
Hellweg

(10) Patent No.: US 9,115,959 B2
(45) Date of Patent: Aug. 25, 2015

(54) QUICK RELEASE GARMENT

(75) Inventor: Albert Hellweg, Mitcham (AU)

(73) Assignee: THF INNOVATION PTY LTD, Bayswater, Victoria (AU)

( * ) Notice: Subject to any disclaimer, the term of this patent is extended or adjusted under 35 U.S.C. 154(b) by 830 days.

(21) Appl. No.: 13/256,180

(22) PCT Filed: Mar. 15, 2010

(86) PCT No.: PCT/AU2010/000301

§ 371 (c)(1),
(2), (4) Date: Sep. 12, 2011

(87) PCT Pub. No.: WO2010/102351

PCT Pub. Date: Sep. 16, 2010

(65) Prior Publication Data

US 2012/0000004 A1 Jan. 5, 2012

(30) Foreign Application Priority Data

Mar. 13, 2009 (AU) ..... 2009901069

(51) Int. Cl.
*A41D 1/04* (2006.01)
*F41H 1/02* (2006.01)
*A41D 13/00* (2006.01)

(52) U.S. Cl.
CPC ..... *F41H 1/02* (2013.01); *A41D 13/0012* (2013.01); *A41D 2400/44* (2013.01)

(58) Field of Classification Search
CPC ..... A41D 1/04
USPC ..... 2/102, 2.5, 48, 69, 456, 460–463, 467, 2/44, 45, 50, 51, 69.5, 94, 108, 326, 2/327–334; 24/630, 631, 633, 634
See application file for complete search history.

(56) References Cited

U.S. PATENT DOCUMENTS 5,275,437 A * 1/1994 Modinger et al. ..... 280/806
6,421,888 B1 * 7/2002 Grenga et al. ..... 24/601.5

(Continued)

FOREIGN PATENT DOCUMENTS

DE 102007058124 A1 6/2009
GB 577157 A 5/1946

(Continued)

OTHER PUBLICATIONS

International Search Report for PCT/AU2010/000301 mailed Jun. 10, 2010.

(Continued)

*Primary Examiner* — Khoa Huynh
*Assistant Examiner* — Khaled Annis
(74) *Attorney, Agent, or Firm* — Dorsey & Whitney LLP

(57) ABSTRACT

Exemplary embodiments of a quick release garment can be provided. The exemplary garment can include a plurality of co-operable garment panels, which when interconnected, can form a garment in a condition wrapped about an upper torso of a person, a plurality releasable mechanical latches, each latch having a first and a second portion and at least one latch element biased towards an engaged condition, releasably engageable to interconnect the garment panels, and a release arrangement operable in a single operation to release the latches. Further, the latches can be structured so that the single operation allows the garment to fall from the upper torso, and the garment can thereafter be rapidly restorable to the condition wrapped about the upper torso by re-engaging each of the latches by pushing the first and second portions together against the bias to re-engage the latch element(s).

37 Claims, 8 Drawing Sheets

(56) References Cited

U.S. PATENT DOCUMENTS

| | | | | |
|---|---|---|---|---|
| 6,769,137 | B2 | 8/2004 | D'Annunzio | |
| 6,796,007 | B1 * | 9/2004 | Anscher | 24/633 |
| 7,047,570 | B2 | 5/2006 | Johnson | |
| 8,181,318 | B2 * | 5/2012 | Anscher | 24/634 |
| 2002/0092140 | A1 | 7/2002 | Van Tassel | |
| 2003/0097737 | A1 * | 5/2003 | Gartsbeyn | 24/599.7 |
| 2005/0005343 | A1 | 1/2005 | Johnson | |
| 2007/0107109 | A1 | 5/2007 | Johnson | |
| 2010/0235957 | A1 * | 9/2010 | Dovner et al. | 2/2.5 |
| 2010/0313392 | A1 * | 12/2010 | Anscher | 24/616 |
| 2012/0030852 | A1 * | 2/2012 | Anscher | 2/102 |

FOREIGN PATENT DOCUMENTS

| | | |
|---|---|---|
| NL | 2000496 | 8/2008 |
| WO | WO 2007/146810 | 12/2007 |
| WO | WO 2008/094280 | 8/2008 |
| WO | WO 2008/108856 | 9/2008 |
| WO | WO 2009/047790 | 4/2009 |
| WO | WO 2009/126190 | 10/2009 |
| WO | 2009143464 A2 | 11/2009 |

OTHER PUBLICATIONS

International Written Opinion for PCT/AU2010/000301 mailed Jun. 10, 2010.

European Patent Ofice, Extended European Search Report dated Apr. 7, 2014, Application No. 10750254.4, 7 pages.

* cited by examiner

QUICK RELEASE GARMENT

CROSS REFERENCE TO PRIOR APPLICATIONS

This application is a U.S. National Stage application of International Application No. PCT/AU2010/000301, filed on Mar. 15, 2010 and published on Sep. 16, 2010 as International Publication No. WO 2010/102351, which claims priority to Australian Patent Application No. 2009901069 filed on Mar. 13, 2009. The entire disclosures of these applications are incorporated by reference herein in their entireties.

FIELD OF THE DISCLOSURE

The present disclosure relates generally to garments for the upper torso that include arrangements for quick release when such action is called for, for example in the event of an emergency. The present disclosure can be, for example, of particular application to load-bearing vest-type garments of a kind commonly worn by military and police personnel.

BACKGROUND OF INFORMATION

Load-bearing vest-style garments are commonly worn by military and police personnel so that they may carry equipment such as tools, radios, truncheons, small weaponry, handcuffs, mace or taser devices and anti-ballistic protection panels. It can be appreciated that garments of this type therefore tend to be bulky and heavy when loaded, and may restrict the movement of the wearer. A recognized requirement can be therefore to be able to ditch these vests with minimal delay, for example, in an emergency situation such as a crash-landing helicopter or in order to be rescued from a damaged vehicle or other entrapment situation.

A known approach to providing for quick release of load-bearing vest-style garments can include a separate set of rapid release linking devices in the garments. Typically, donning and securing of these garments under normal conditions can involve manual engagement of a number of Velcro (hook and loop) primary fasteners at or adjacent the waist and adjacent each shoulder. Normal doffing of the garment simply typically requires disengagement of the primary fasteners. A separate set of linking elements can be associated with either the hook or the loop component of the primary fasteners for effecting quick release of the garment from the wearer's body.

For example, International Patent Publication No. WO 2008/108856 describes an anti-ballistic vest garment having a quick release mechanism. The front panel of the garment is attached to side interface panels by respective sets of interleaved loops joined by respective cables. The cables meet in end loops at the centre bottom of the garment and pass up the respective sides and along the top of the front panel. The end loops provides handles by which the wearer can simultaneously pull both cables out of the interleaved loops, whereupon the garment drops off the wearer.

In the arrangement described in U.S. Published Patent Application No. 2007/0107109, a garment can be made from a number of panel components drawn together at a central location in the garment and attached using aligned eyelets, a common loop pulled through the eyelets and a single pull cord threaded through the loop. In this case, the single cord can be pulled to release multiple garment components simultaneously.

These systems relying on a single draw cable may be effective in causing substantially simultaneous separation of multiple garment components and therefore the rapid release of the garment from the wearer's body. However, in many of the instances where quick release of the garment is desired, it can be equally preferred that the garment is subsequently easily and quickly reinstated to the wearer's body. Such instances can include, e.g., scrambling through a narrow opening when on patrol, escaping from a helicopter or vehicle, entering a damaged vehicle to retrieve an injured or trapped soldier, and climbing up a wall or other structure. Indeed, it may be imperative in some cases that a soldier is able to rapidly redeploy the garment in order to continue the mission, or for their own safety. The prior arrangements that rely on a single draw cable or cord extending through multiple loops or eyes in the garment cannot be easily reassembled on the wearer's body and can require a tedious process of re-threading the cable or cord through all of the loops or eyelets in the correct order.

In order to more readily facilitate reassembly of a protective vest subsequent to removal, International Patent Publication No. WO 2007/146810 describes an arrangement in which one or more Velcro (hook and loop) or snap link fastener strips are arranged adjacent respective zipper/buckle fastenings. The arrangement is such that the or both fastener strips can be very quickly separated by a single motion that pulls apart the vest collars: the garment is fully opened for removal but does not drop off. In effect, this approach entails opening of the garment, rather than its complete dropping away from the body, as a compromise in order to allow more rapid re-closure.

It is an object of the present disclosure to provide for quick release of a garment such as a load-bearing vest in a manner that facilitates quick redeployment of the garment.

Reference to any prior art in the specification is not, and should not be taken as, an acknowledgment or any form of suggestion that this prior art forms part of the common general knowledge or that this prior art could reasonably be expected to be ascertained, understood and regarded as relevant by a person skilled in the art.

SUMMARY OF EXEMPLARY EMBODIMENTS OF THE DISCLOSURE

Exemplary embodiments of the present disclosure can provide a quick release garment including:

a plurality of garment panels co-operable when interconnected to form a garment in a condition wrapped about at least an upper torso of a person;

a set of releasable mechanical latches, each having a first and a second portion and at least one latch element biased towards an engaged condition, releasably engageable to interconnect the garment panels to form the garment in the condition; and release elements carried on the garment and operable in a single operation by one hand to mechanically and substantially simultaneously release the latches by disengaging the latch element(s);

where the set of releasable mechanical latches can be arranged so that the single operation allows the garment to fall from said upper torso, and where the garment is thereafter rapidly restorable to the condition wrapped about at least the upper torso from which it fell, by re-engaging each of the releasable mechanical latches by pushing the first and second portions together against the bias to re-engage the latch element(s).

Advantageously, the elements carried on the garment and operable in a single operation by one hand to mechanically and substantially simultaneously release the latches includes a pull cord or cable configuration in which a single cord or cable with a hand grip at its remote end can be arranged to pull, via a multiplex coupling device, respective cables coupled to the mechanical latches.

In another exemplary embodiment, the present disclosure can provide a quick release garment including:

a plurality of garment panels co-operable when interconnected to form a garment in a condition wrapped about at least an upper torso of a person;

a set of releasable mechanical latches releasably engageable to interconnect the garment panels to form the garment in the condition; and release elements carried on the garment and operable in a single operation by one hand to mechanically and substantially simultaneously release the latches, which means includes a pull cord or cable configuration in which a single cord or cable with a hand grip at its remote end can be arranged to pull, via a multiplex coupling device, respective cables coupled to the mechanical latches, whereby the garment falls from the upper torso.

In either of the embodiments, each of the mechanical latches may include one or preferably two latch elements that are spring-loaded to the latching condition but withdrawable by the aforesaid cable against the spring, and a tongue element having latchable formations cooperable with the latch elements. The arrangement can be such that the tongue element may be pressed home in a fashion that pushes back the latch elements for effecting the reengagement of the releasable mechanical latches.

The set of releasable mechanical latches preferably can include one such latch that when engaged interconnects two of the garment panels adjacent the upper torso below the armpits, and at least one such latch that when engaged interconnects two of the garment panels of which one extends over at least one shoulder of the upper torso. More preferably, there can be a pair of the latches below the armpits and a pair associated with garment panels that extend over the respective shoulders.

Preferably, the garment includes a second set of devices for interconnecting garment panels of the plurality if garment panels, which second set are distinct from the set of releasable mechanical latches. The second set of devices for interconnecting garment panels can be selected for use in donning the garment on the normal commencement of duty involving the wearing of the garment, as distinct from occasions when the garment is to be restored to the aforesaid condition wrapped about at least the upper torso from which it is fallen, by re-engaging the releasable mechanical latches. Suitable such devices include complementary hook and loop fastener pads and extended buckles such as snap engageable/press releasable buckles.

Typically, there can be garment panels among the plurality of garment panels that have one of the set of releasable mechanical latches at one location thereon, and one of the set of interconnecting devices at another location thereon.

Advantageously, the quick release garment can further include elements to protect against inadvertent or accidental release of the latches. The elements to protect may be a safety catch device, whereby the hand grip is releasably attached to the garment, such that a positive release of the safety catch must occur before the hand grip can be pulled with respect to the garment, whereby the release of the safety catch and the pulling of the hand grip combined constitutes the single operation by one hand.

Preferably, the multiplex coupler can be held in a fixed location relative to the garment. The pull cord preferably translates relative to the multiplex coupler. The pull cords may be covered by but not fixed to an outer sheath.

The first portion can be preferably a female housing having a recess, and the second portion is preferably a male housing having a protruding tongue for releasable insertion into the recess of the first portion. The latch elements may be biased to project from within the female housing into the recess, whereby they latch within formations in the tongue of the male housing. The latch elements can be advantageously chamfered pins. The recess can be preferably covered and the latch elements can be preferably activated by chords pulling against the bias.

These and other objects, features and advantages of the exemplary embodiment of the present disclosure will become apparent upon reading the following detailed description of the exemplary embodiments of the present disclosure.

BRIEF DESCRIPTION OF THE DRAWINGS

The present disclosure will now be further described, by way of example only, with reference to the accompanying drawings, in which.

Figure 1A:
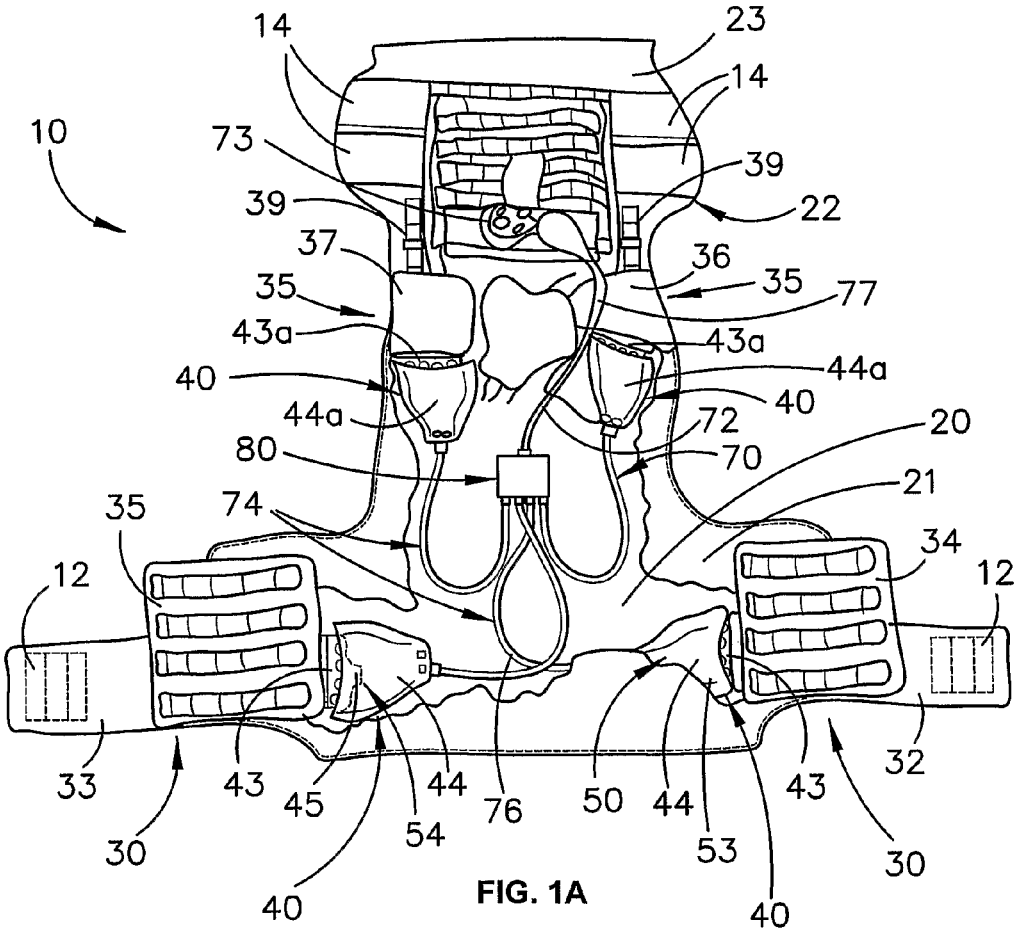
FIG. 1A is a partially open laid flat view of a load-bearing vest garment in accordance with an embodiment of the present disclosure, with the outer layer of the back panel largely cut away so as to gain a better view of the quick release mechanism.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described exemplary embodiments without departing from the true scope and spirit of the subject disclosure.

DETAILED DESCRIPTION OF EXEMPLARY EMBODIMENTS

An exemplary embodiment of a garment illustrated in FIG. 1A is an exemplary embodiment of a load-bearing vest 10 intended to be worn about the upper torso of military or police personnel, and includes, for example, multiple flexible panels, typically fabric panels, that include inner and outer back layers 20, 21, and inner and outer front layers 22, 23, that can be interconnected and able to be assembled together about the upper torso of a wearer by means of a pair of side waistband assemblies 30 and a pair of shoulder strap assemblies 35. In each case the back and front inner and outer layers match and can be assembled together by stitching or the like to define an interior space. The outer layers typically can exhibit camouflage colors on their outside and can normally carry a variety of open pockets, zippered pockets, tie straps and the like by which the wearer can carry a selection of devices, tools and weapons according to the requirements of the day.

The side waistband assemblies 30 and the shoulder strap assemblies 35 can incorporate two different sets of devices for interconnecting the back and front panels. At each assembly, there can be, firstly, a conveniently engageable and releasable fastening device for use when "normally" donning the garment or doffing it at the conclusion of an operation, and, secondly, a mechanical latch that is releasable, by means to be discussed, to achieve quick release of the garment in an emergency. In accordance with exemplary embodiments of the present disclosure, several releasable mechanical latches can be substantially simultaneously released.

Each side waistband assembly 30 can have an inner elongate waistband panel 32, 33, and an outer side panel 34, 35 of a profile nearer to square. On the inner face, at the front end of each waistband panel 32, 33, can be affixed one of the cooperating pads 12 of a hook and loop fastener, the other pad 14 can be disposed on the outside face of front panel 23. Fitted to the other or rear end of the waistband panels 32, 33, and firmly sandwiched between the waistband panels 32, 33 and the respective side panel 34, 35, can be a first component, tongue 43 of a mechanical latch 40.

Figure 1B:
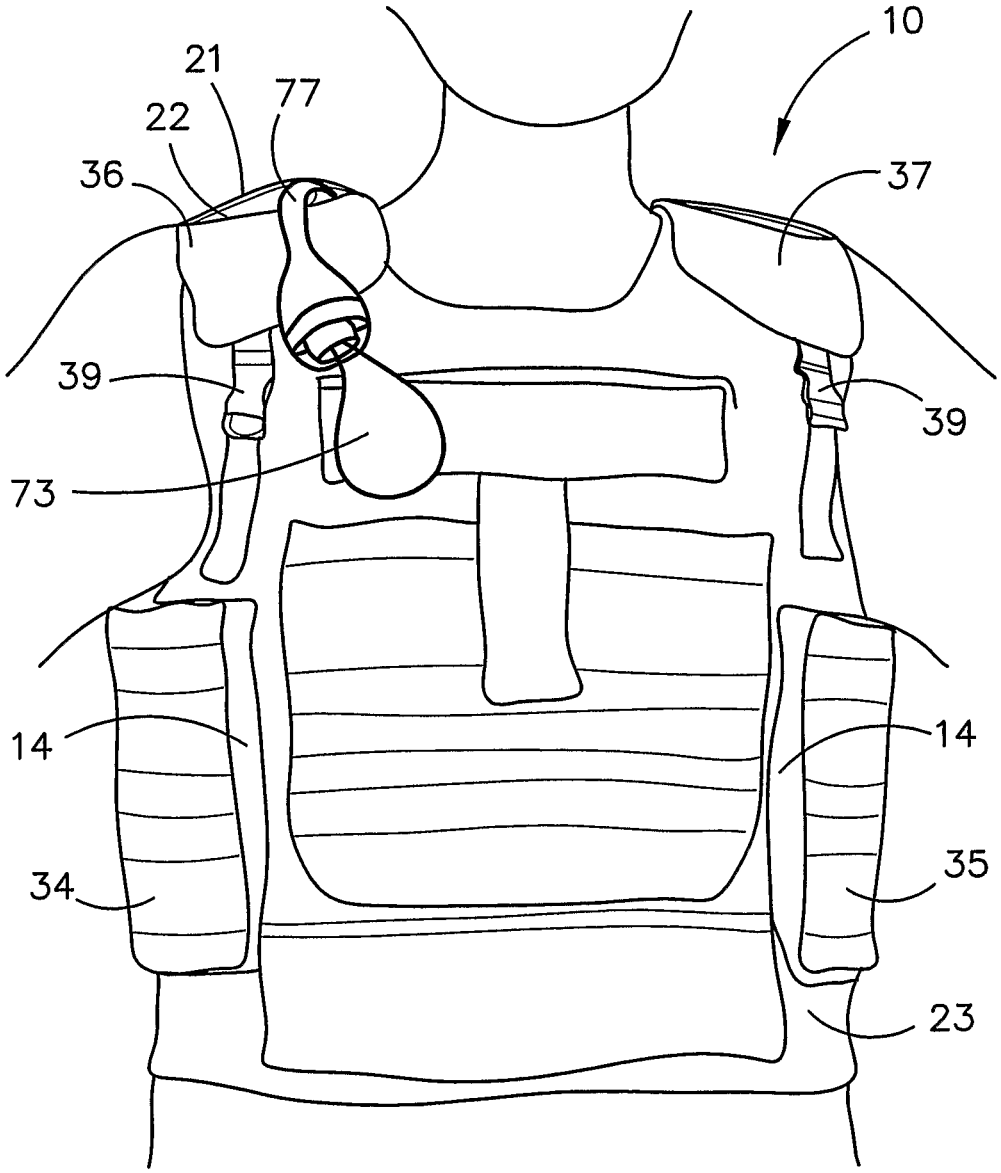
FIG. 1B is a front view of the load-bearing vest garment of FIG. 1A1 assembled as worn by a user.
Figure 2:
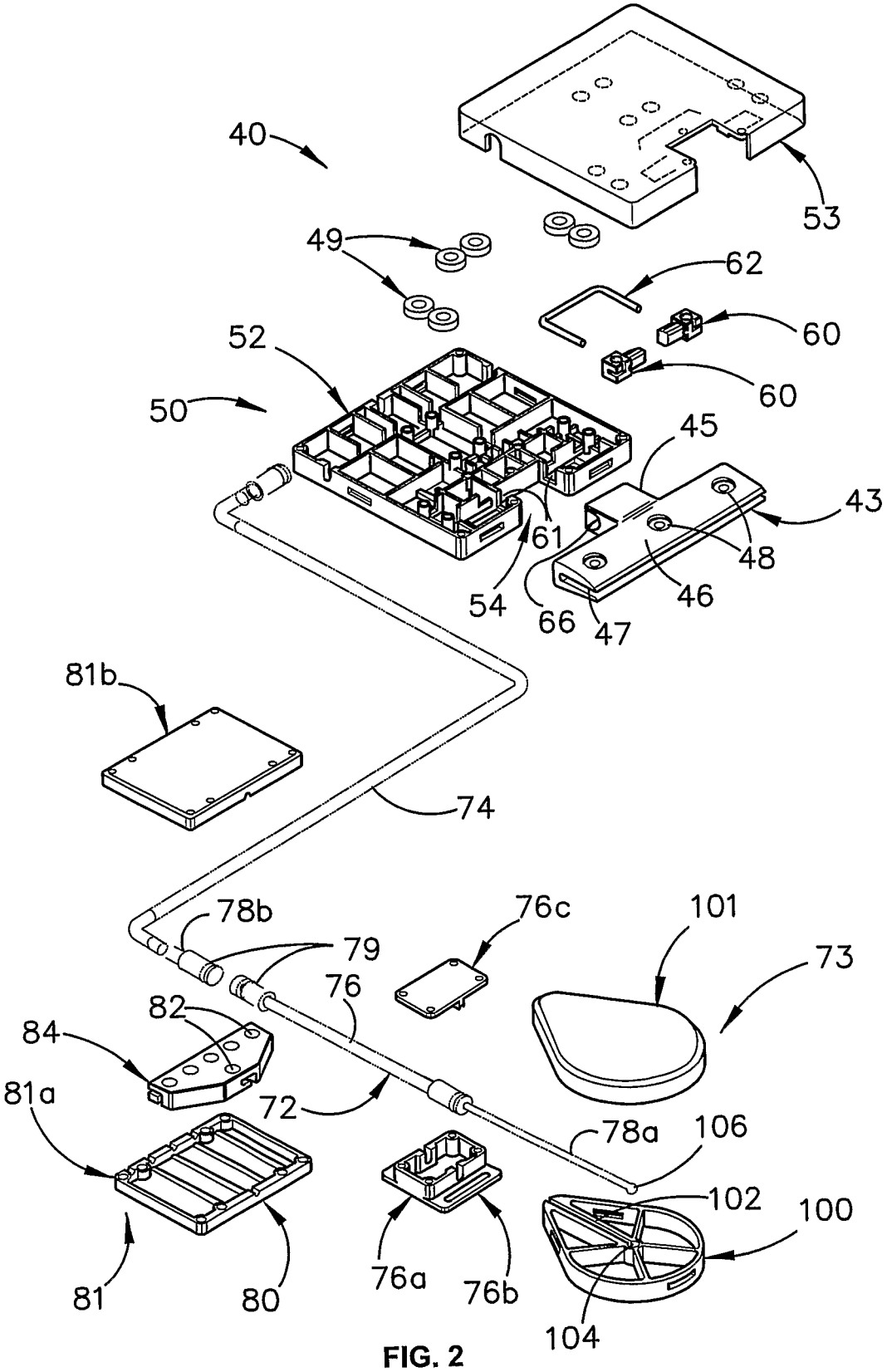
FIG. 2 is a fragmentary view of the principal components of the quick release mechanism in accordance with an embodiment of the present disclosure.
Figure 3:
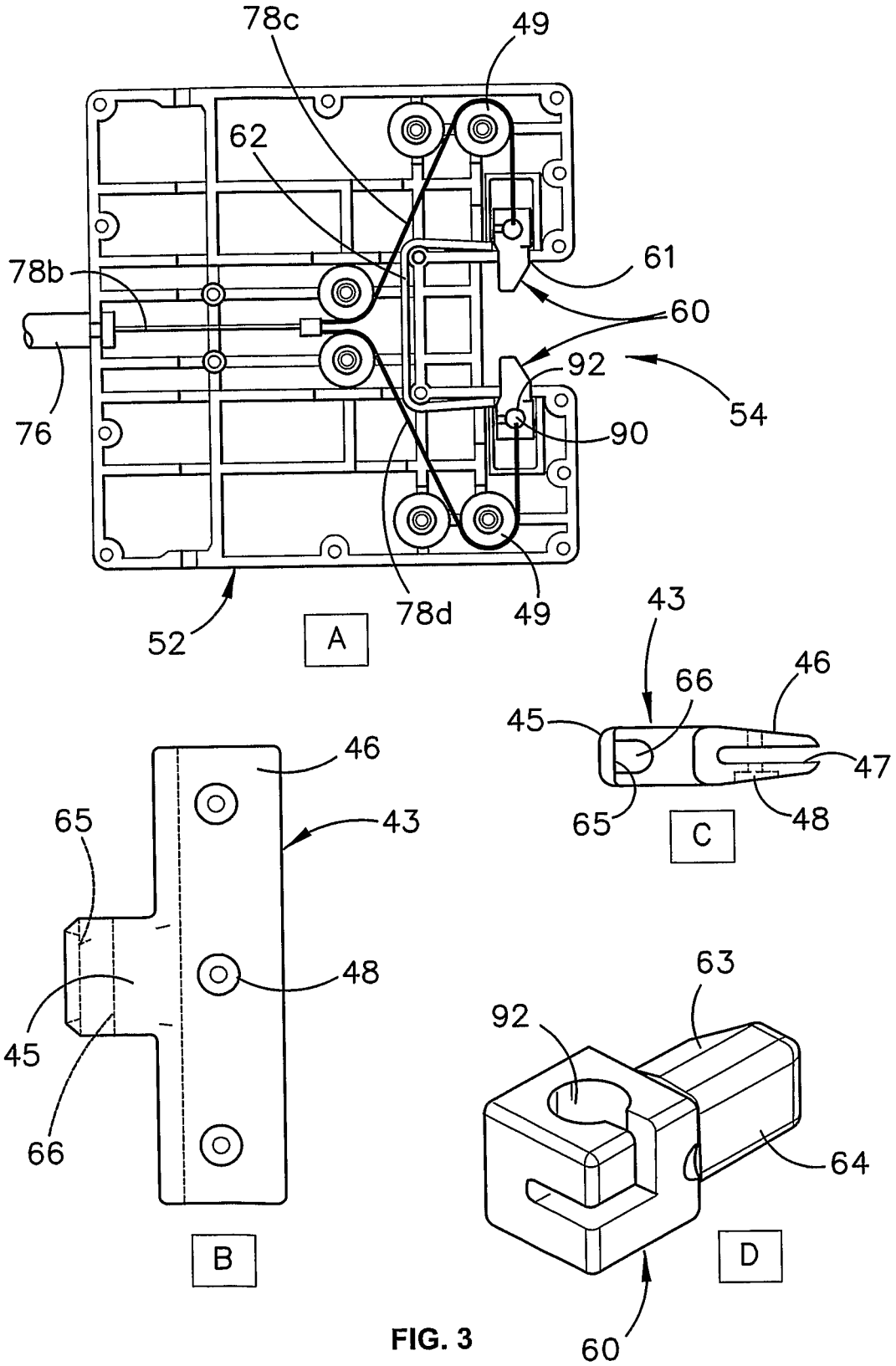
FIG. 3 is a set of diagrams of components of one of the mechanical latches of the quick release mechanism in accordance with an embodiment of the present disclosure.

Similarly, as shown in FIGS. 1A and 1B, each shoulder strap assembly 35 can have a shoulder strap panel 36, 37 that in situ lies over the wearer's shoulder and can be fastened to the front panel by an outside strap and buckle 39. At the rear end, behind the shoulder In situ, can be fitted a tongue component 43*a* similar to the tongue components 43 of the waistband panels 32, 33. Firmly secured within the interior space formed between inner and outer back layers 20, 21 can be the four second components, female components 44, 44*a* of the mechanical latches 40 of which tongue components 43, 43*a* form the complementary male part. Each of these female components 44,44*a* can have a rectangular two-part housing 50, with a base 52 (see FIGS. 2 and 3), a cover 53 and a central rectangular recess 54 at a front edge. This recess 54 can receive a projecting tongue 45 of rectangular shape matching the recess: tongue 45 can be formed integrally with a cross piece 46 of tongue component 43, 43*a*. The cross piece 46 can be of a u-shaped side cross section (see FIG. 2) to define a slot 47 to receive the respective fabric of the garment panel to which it is secured by spaced fasteners in countersunk apertures 48.

Recess 54 can have a pair of slidable latch elements, pins 60 located in slots 61 in opposed positions to either side of the recess. Latch pins 60 can be biased to their forward condition protruding into recess 54 by a shaped spring-steel spring 62 that can embrace the latch pins and bias them towards each other. Latch pins 60 further can have forward chamfered faces 63 (see FIG. 3D) by which tongue 45 can push back the latch pins as the tongue enters the recess, and respective rearward faces 64 that engage a back edge 65 of a rectangular transverse bore 66 in tongue 45. Bore 66 can be dimensioned to slidably receive the two latch pins at its respective ends. Spring 62 can ensure that the two latch pins snap into place in this transverse bore 66 once tongue 45 is far enough into the recess 54. It can be appreciated that the latch pins 60 may be located on the tongue component 43 and be biased outwardly into apertures in the female component 44.

A plurality of (e.g. four) mechanical latches 40—two at or above the waist line below the armpits and two at the rear of the shoulders—can be substantially simultaneously releasable at will by a hand-operated cable mechanism 70 of the bowden cable type. A primary cable 72 can have a hand-grip 73 by which the cable can be actuable, by being pulled, to in turn activate each of four secondary cables 74 coupled to the respective female components 44 of the latches 40. This transfer of the hand tug on the primary cable can be via a mechanical multiplex coupler 80, which can be fastened to the vest. Each of the cables 72,74 can have an external sheath 76 and an internal wire 78*a*, 78*b*. The sheaths can be fixed, to prevent their translation, to the housings 50 of the latches 40, to the housing 81 of the multiplex coupler 80 and, in the case of the primary cable 72, via a sheath lock 76*a* (including base 76*b* and cover 76*c*) to a fabric outer sheath 77 fastened at its rear end to a top edge portion of the back panels 20, 21. The sheaths can protect the cables and allow the cables to move even though the garment may be squashed against a surface. Housings 50 and 81 are in turn fastened to the back panels 20, 21. Handgrip 73 can be a two-part housing 100, 101 of teardrop shape with an internal wire channel 102 terminating at an enlarged end 104 to locate a bulb 106 on the end of primary cable wire 78*a*.

Figure 6:
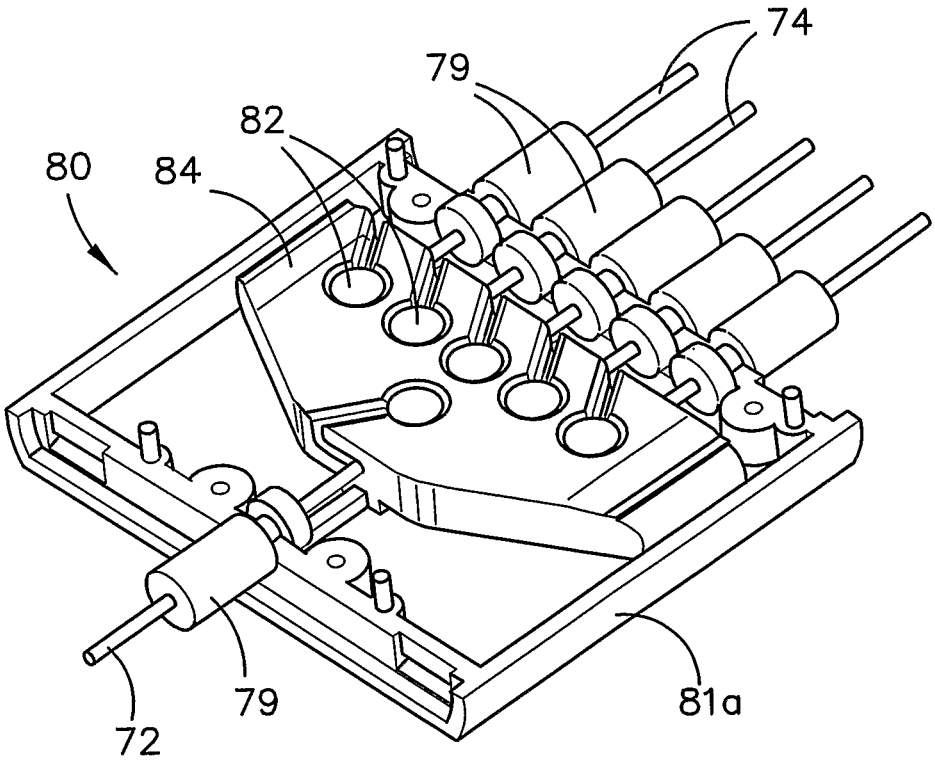

Each of the five wires 78*a*, 78*b* can have an end piece 79 of cylindrical form that can be held in a matching aperture 82 (FIG. 6) of an internal slide 84 within the housing 81 of multiplex coupler 80. Housing 81 can include a base 81*a* and a cover 81*b*. Drawing the wire 78*a* of primary cable 72 relative to its sheath can pull the slide 84 forward in its housing 81 and thereby in turn tug on the wires 78*b* of the secondary cables. FIG. 3A illustrates how, within the housings 50 of mechanical latches 40, the respective wire 78*b* can be forked into two branch wires 78*c*, 78*d* that can be led about pulleys 49, to be retained by terminal endpieces 90 in matching apertures 92 in the latch pins 60.

Figure 4:
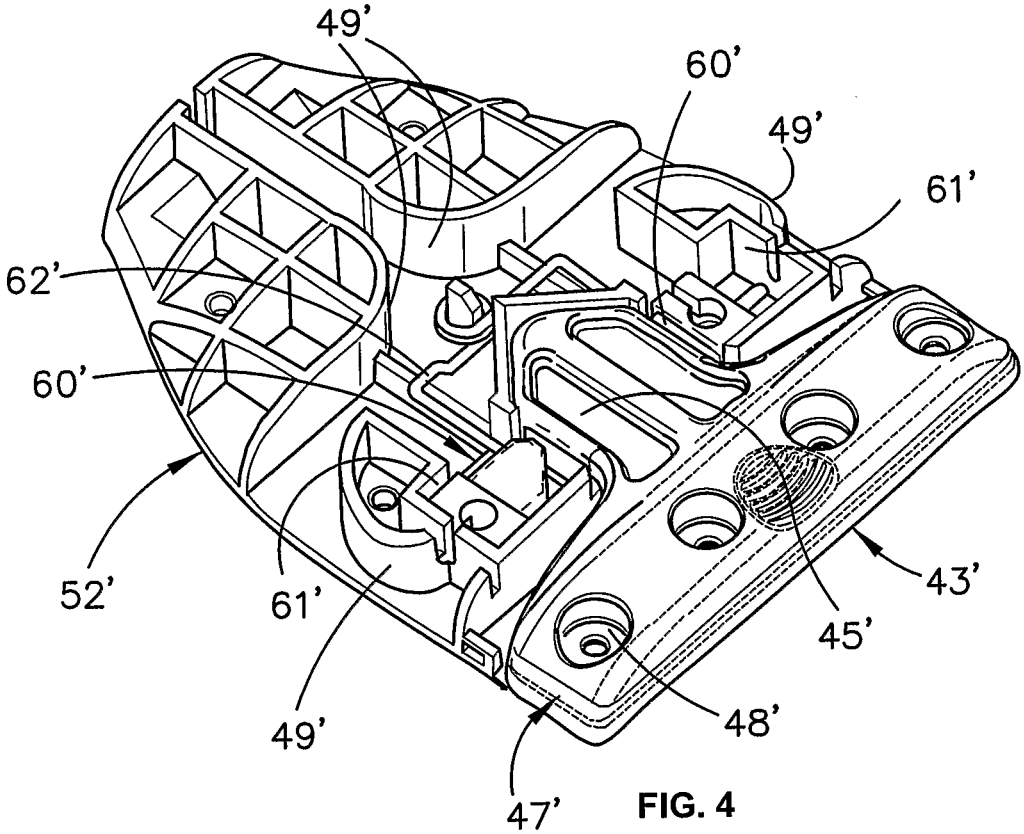
FIG. 4 is a cut-away perspective view of a mechanical latch with internal modifications relative to the latch depicted in FIG. 3.
Figure 5:
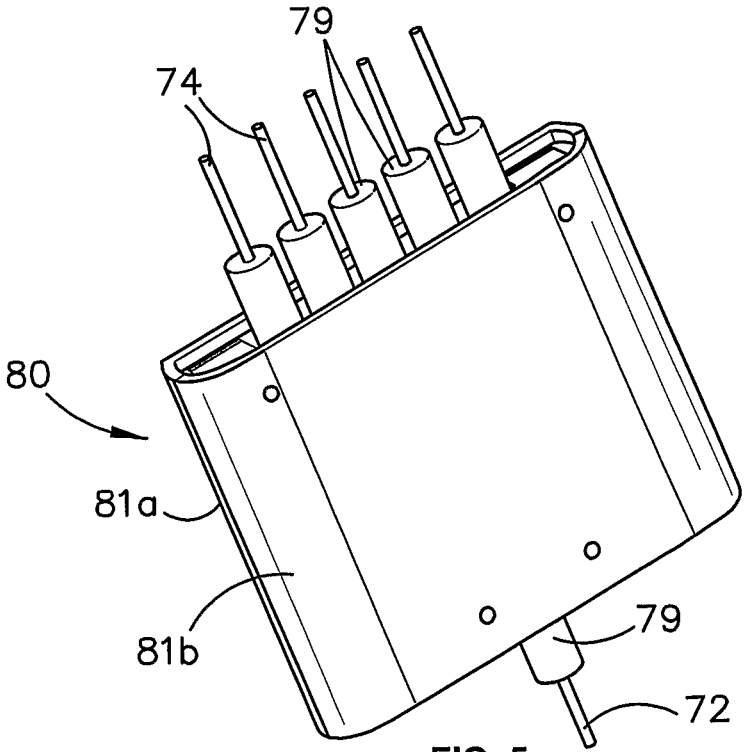
FIGS. 5 and 6 are respectively a plan view and an internal isometric view of the multiplex coupler of the hand-operated cable mechanism.

In a modification or another exemplary embodiment (see FIG. 4), pulleys 49 can be dispensed with and the cable branch wires can be guided to latch pins 60' by suitably profiled internal integral guide walls 49'. The latch pins 60' can be shown in the two positions, one biased into recess 54 and bore 66, the other withdrawn. The housing in this embodiment can provide protection over the recess to seal against dust entering and locking up the latch pins 60'.

For example, the cable mechanism 70 can be pre-dimensioned accurately so that the arrangement can be operable in a single operation, by one hand drawing on handgrip 73, to mechanically and substantially simultaneously release latches 40. Because this release of the latches can wholly separate the garment into two segments—the assembly of the back panels 20, 21 with the built in cable and latch configuration and the front panels 22, 23 still attached to the waist band panels, side panels and shoulder strap panels—this single operation by one hand can be effective to allow the garment to fall from the torso on which it is worn, thus achieving the requirement for quick release of the garment.

When the wearer has carried out the action which necessitated quick removal of the garment (e.g., perhaps pulled a colleague from a damaged vehicle or otherwise out of harm's way, crawled through a narrow opening, or cleared an obstacle) the garment can thereafter be rapidly restorable to its condition wrapped about the wearer's upper torso from which it fell by draping the two separated sections in position and rapidly one-by-one re-engaging the mechanical latches by pushing the respective tongue components 43 home into the recesses 54 of the female components 44. One way in which this might be best achieved would be, e.g., to first fasten the shoulder latches and then drop the garment onto the shoulders about the wearer's head before fastening the side latches.

Figure 7:
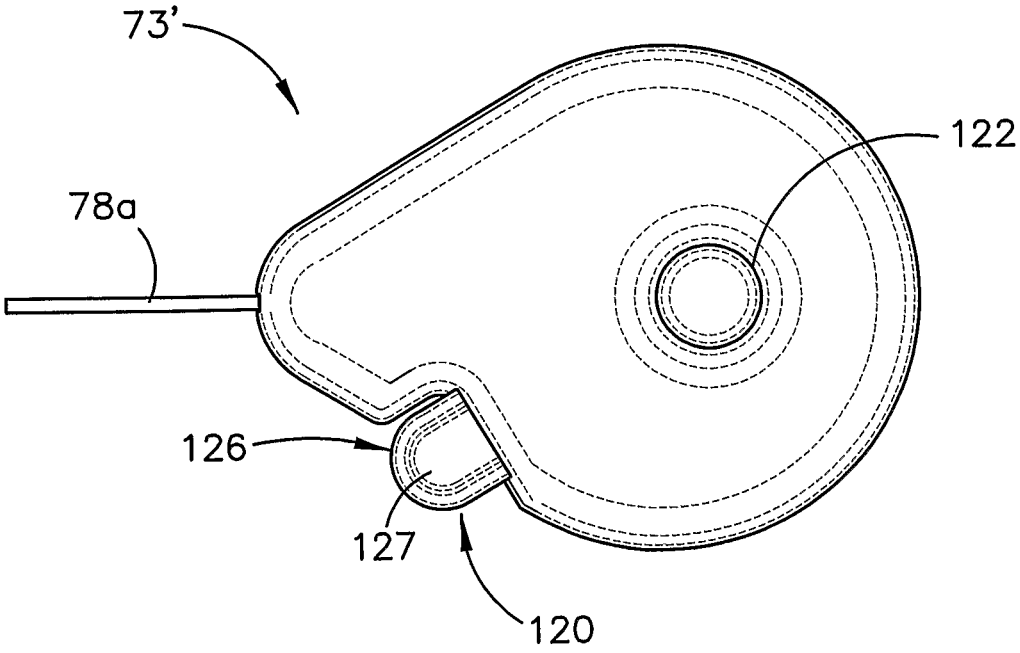
FIG. 7 is a plan view of a modified form of the cable hand grip, fitted with a safety catch device.
Figure 8A:
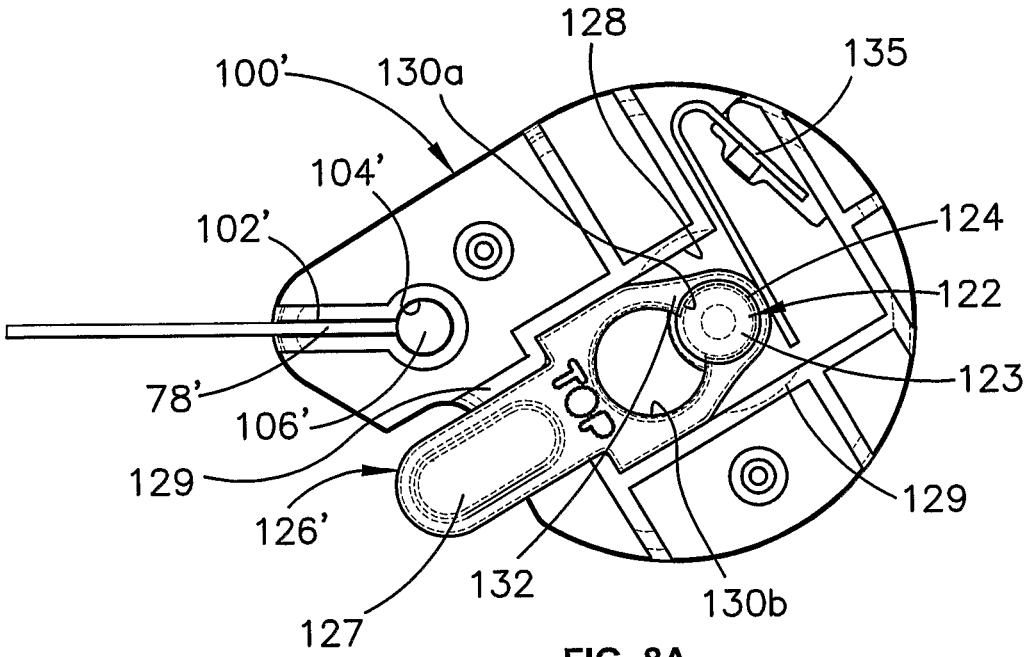
FIG. 8A is a view similar to FIG. 7 but with the top cover removed.
Figure 8B:
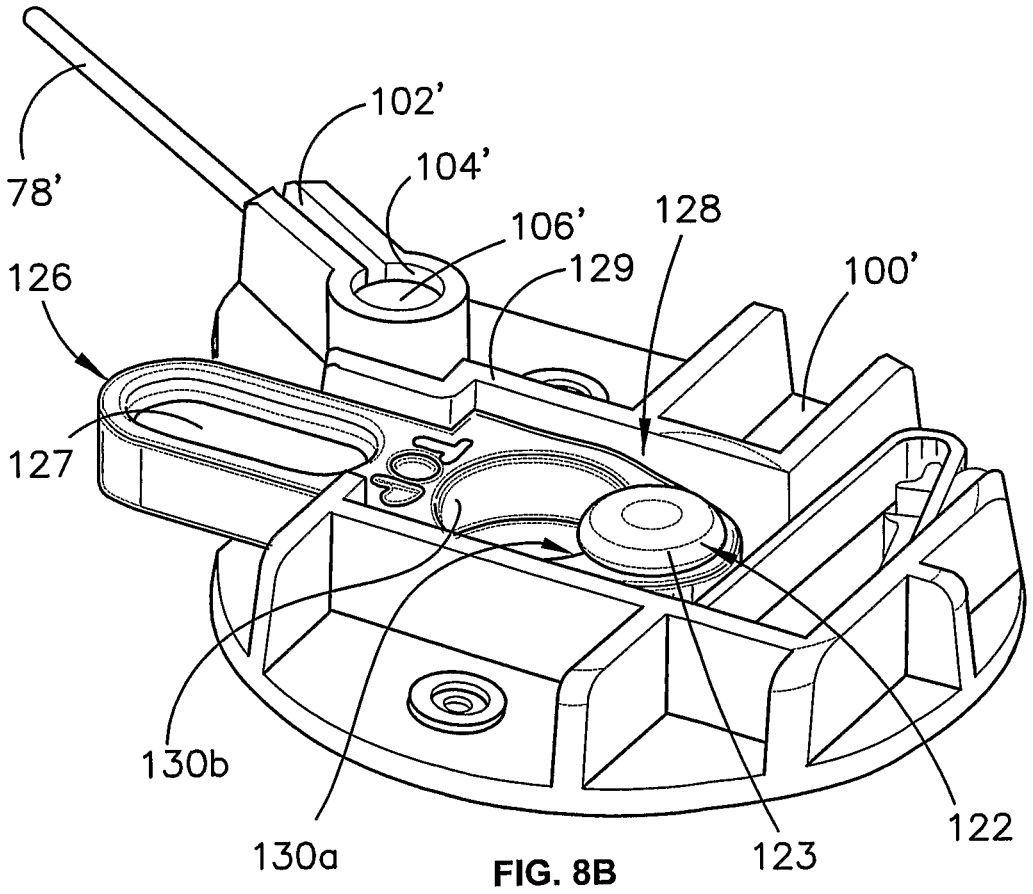
FIG. 8B is a perspective view of the cable hand grip of FIG. 8A.
Figure 9:
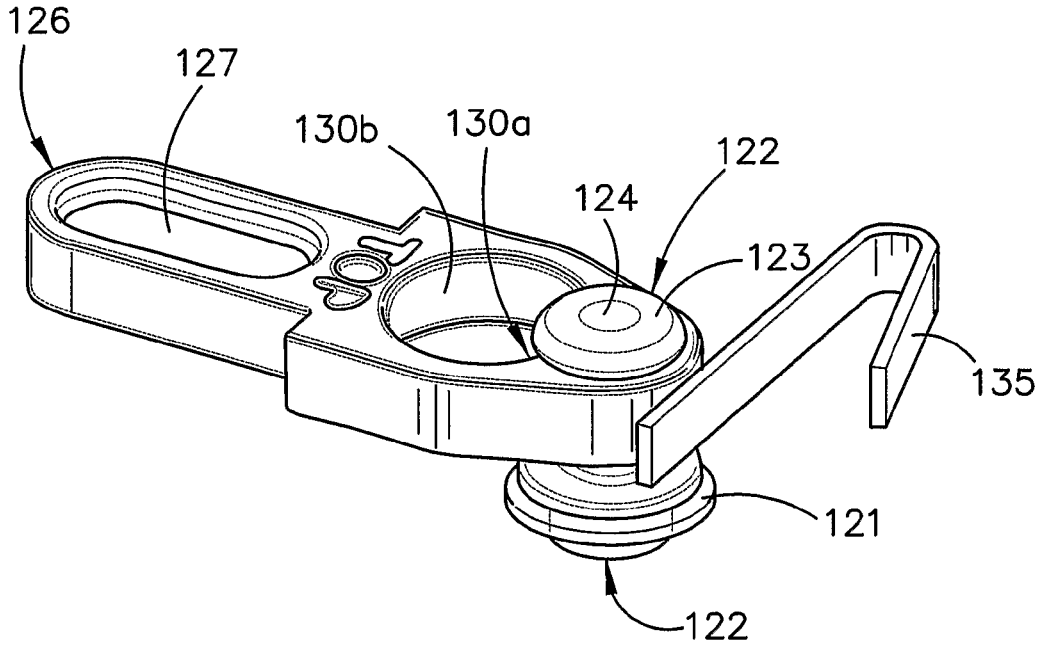
FIG. 9 is a fragmentary view of the safety catch slide with its mounting stud and spring in accordance with an embodiment of the present disclosure.

FIGS. 7 to 9 depict an exemplary embodiment of a modified cable hand grip 73' fitted with a safety catch device 120 to prevent inadvertent or accidental release of the vest. A primary cable wire 78' can be retained as before by locating a bulb 106' at the end of the wire in an enlarged end 104' of a wire channel 102'. However, in this exemplary case, the hand grip 73' can be normally immovably retained on the garment by means of a stud 122 sewn at its base into the garment (represented at 121 in FIG. 9) and having a cylindrical head 123 that protrudes into but not through the interior of the hand grip and has an enlarged end 124.

A slide 126 can be linearly moveable in a guideway 128 defined by internal ribs 129. Stud head 123 can protrude into the centre of the guideway 128 and slide 126 can have two apertures: a first aperture 130*a* that snugly embraces stud head 123 but can be smaller than stud end 124, and a second adjacent aperture 130*b*. A neck 132 between apertures 130*a*, 130*b* can be deformable or compressible to allow the stud head to move relatively between the apertures. When stud 122 protrudes through aperture 130*a*, preferably, hand grip 73' cannot be lifted off the stud, to permit operation of the cable release mechanism; when the stud protrudes through aperture 130*b*, there is preferably no such restraint.

Slide 126 can be biased, by a spring steel clip 135, to the position in which stud 122 can be in aperture 130*a* and the outer end of the slide can protrude from housing 100' as a push "button" 127. The wearer who wishes to operate the quick release mechanism preferably executes, in one operation, through two actions, e.g.: firstly press in the "button" 127, which positions stud 122 in aperture 130*b*, and then simultaneously lift the hand grip housing 100' off the garment and pull it down to operate the cable mechanism 70 to release the mechanical latches 40 as in the embodiment of FIGS. 1 to 3, 5 and 6.

It can be understood that the exemplary embodiments of the present disclosure disclosed, described and defined in this specification extends to all alternative combinations of two or more of the individual features mentioned or evident from the text or drawings. All of these different combinations constitute various alternative aspects of the present disclosure.

The invention claimed is:

1. A quick release garment, comprising:

a plurality of co-operable garment panels, which when interconnected, form a garment in a configuration wrapped about at least an upper torso of a person;

a plurality of releasable mechanical latches, each of the latches having a first portion, a second portion and at least one latch element provided with a bias towards an engaged condition, the mechanical latches being releasably engageable to interconnect the garment panels to form the garment in the configuration wrapped about at least an upper torso of a person; and a release arrangement including a pull cord or a cable configuration in which a single cord or a cable with a hand grip at its remote end is structured to pull, via a multiplex coupling device, respective cables coupled to the mechanical latches, wherein the release arrangement is disposed on the garment and operable in a single operation by one hand to mechanically and substantially simultaneously release the latches by disengaging the at least one latch element, each latch element being disengaged by withdrawing the latch element against said bias;

wherein the plurality of releasable mechanical latches is structured so that the single operation allows the garment to fall from the upper torso, and wherein the garment is rapidly restorable to the condition wrapped about at least the upper torso from which it fell, by re-engaging each of the releasable mechanical latches by pushing the first and second portions together, each latch element being pushed back against said bias until the latch element snaps into place and is reengaged.

2. The garment of claim 1, wherein the multiplex coupling device includes a housing fastened to the garment structured for holding the multiplex coupling device in a fixed location relative to the garment.

3. The garment of claim 2, wherein a movable element within the housing is attached to the single cord or the cable and to the respective cabled coupled to the latches, wherein a tug on the single cord or cable with the hand grip pulls the moveable element and thereby in turn tugs the respective cables.

4. The garment of claim 3, wherein the single cord or the cable, and the respective cables, are non-fixedly covered by an outer sheath.

5. The garment of claim 1, further comprising a protection arrangement structured to protect against an inadvertent release or an accidental release of the latches.

6. The garment of claim 5, wherein the protection arrangement includes a safety catch device by which the hand grip is releasably attached to the garment, such that a positive release of the safety catch device must occur before the hand grip can be pulled with respect to the garment, wherein the single operation by one hand includes a release of the safety catch and the pulling of the hand grip.

7. The garment of claim 1, wherein the single cord or cable, and the respective cables, are non-fixedly covered by an outer sheath.

8. The garment of claim 1, wherein the at least one latch element is spring loaded to the engaged condition but withdrawable by the release arrangement against the spring, the first or second portion having a tongue element having a formation co-operable with the at least one latch element.

9. The garment of claim 1, wherein the plurality of releasable mechanical latches includes one latch that when engaged interconnects at least two of the garment panels adjacent the upper torso below armpits, and at least one other latch that when engaged interconnects two of the garment panels of which one extends over at least one shoulder of the upper torso.

10. The garment of claim 1, wherein at least a pair of the latches are provided below armpits and at least a pair associated with garment panels extend over respective shoulders.

11. The garment of claim 1, wherein the garment includes a plurality of second devices for interconnecting garment panels of the plurality of garment panels, the plurality of second devices being distinct from the plurality of mechanical latches.

12. The garment of claim 11, wherein the second devices for interconnecting garment panels are structured for use in donning the garment on a normal commencement of duty involving the wearing of the garment, as distinct from occasions when the garment is to be restored to the condition wrapped about at least the upper torso from which it is fallen, by re-engaging the releasable mechanical latches.

13. The garment of claim 11, wherein the second devices include complementary hook and loop fastener pads and extended buckles.

14. The garment of claim 13, wherein the extended buckles include at least one of snap engageable or press releasable buckles.

15. The garment of claim 11, wherein the plurality of garment panels have one of the plurality of mechanical latches at one location thereon, and one of the interconnecting devices at another location thereon.

16. The garment of claim 1, wherein the first portion of each of the mechanical latches is a female housing having a recess, and the second portion is a male housing having a protruding tongue for releasable insertion into the recess of the first portion.

17. The garment of claim 16, wherein the at least one latch element is biased to project from within the female housing into the recess, wherein latching within formations in the tongue of the male housing.

18. The garment of claim 17, wherein the at least one latch element is chamfered pins.

19. The garment of claim 16, wherein the recess is covered.

20. The garment of claim 16, wherein the at least one latch element is activated by cables pulling against their bias.

21. The garment of claim 1, further comprising a protection arrangement structured or configured to protect against an inadvertent release or an accidental release of the latches.

22. The garment of claim 21, wherein the protection arrangement includes a safety catch device by which the hand grip is releasably attached to the garment, such that a positive release of the safety catch device must occur before the hand grip can be pulled with respect to the garment, wherein the single operation by one hand includes the release of the safety catch and the pulling of the hand grip.

23. A quick release garment, comprising:

a plurality of co-operable garment panels, which when interconnected form a garment in a configuration wrapped about at least an upper torso of a person;

a plurality of releasable mechanical latches releasably engageable to interconnect the garment panels to form the garment in the configuration; and a release arrangement disposed on the garment and operable in a single operation by one hand to mechanically and substantially simultaneously release the latches, the release arrangement including a pull cord configuration or a cable configuration in which a single cord or a cable with a hand grip at its remote end is structured to pull, via a multiplex coupling device, respective cables coupled to the mechanical latches, whereby the garment falls from the upper torso, wherein the multiplex coupling device includes a housing fastened to the garment for holding the coupling device in a fixed position relative to the garment.

24. The garment of claim 23, wherein a movable element within the housing is attached to the single cord or the cable and to the respective cables coupled to the latches, wherein a tug on the single cord or the cable with the hand grip pulls the moveable element and thereby in turn tugs the respective cables.

25. The garment of claim 23, further comprising a protection arrangement structured to protect against inadvertent or accidental release of the latches.

26. The garment of claim 25, wherein the protection arrangement includes a safety catch device by which the hand grip is releasably attached to the garment, such that a positive release of the safety catch device must occur before the hand grip can be pulled with respect to the garment, wherein the single operation by one hand includes the release of the safety catch and the pulling of the hand grip.

27. The garment of claim 23, wherein the single cord or the cable, and the respective cables, are non-fixedly covered by an outer sheath.

28. The garment of claim 23, wherein the garment includes a second plurality of devices for interconnecting garment panels of the plurality of garment panels, the second devices being distinct from the plurality of releasable mechanical latches.

29. The garment of claim 28, wherein the second devices for interconnecting garment panels are structured for use in donning the garment on the normal commencement of duty involving the wearing of the garment, as distinct from occasions when the garment is to be restored to the configuration wrapped about at least the upper torso from which it is fallen, by re-engaging the releasable mechanical latches.

30. The garment of claim 28, wherein the second devices include a complementary hook and loop fastener pads and extended buckle.

31. The garment of claim 30, wherein the extended buckles include at least one of snap engageable or press releasable buckles.

32. The garment of claim 28, wherein the plurality of garment panels have one of the plurality of releasable mechanical latches at one location thereon, and one of the interconnecting devices at another location thereon.

33. A quick release garment, comprising:

a plurality of co-operable garment panels, wherein the plurality of garment panels includes two first shoulder panels and two second shoulder panels, which when interconnected, form a garment in a configuration wrapped about at least an upper torso of a person;

a plurality of releasable mechanical latches, including a first latch that, when engaged, interconnects the two first shoulder panels to extend over the person's first shoulder when the garment is wrapped about the person; and a second latch that, when engaged, interconnects the two second shoulder panels to extend over the person's second shoulder when the garment is wrapped about the person, each of the latches having a first portion, a second portion and at least one latch element provided with a bias towards an engaged condition, the mechanical latches being releasably engageable to interconnect the garment panels to form the garment in the configuration wrapped about at least an upper torso of a person; and a release arrangement disposed on the garment and operable in a single operation by one hand to mechanically and substantially simultaneously release the latches by disengaging the at least one latch element, each latch element being disengaged by withdrawing the latch element against said bias;

wherein the release arrangement is operable in said single operation to mechanically and substantially simultaneously release the first and second latches and disconnect the two first shoulder garment panels and to disconnect the two second shoulder garment panels so that the single operation allows the garment to fall from the upper torso; and wherein the garment is rapidly restorable to the condition wrapped about at least the upper torso from which it fell, by re-engaging each of the releasable mechanical latches by pushing the first and second portions together, each latch element being pushed back against said bias until the latch element snaps into place and is reengaged.

34. The garment of claim 33, wherein the plurality of releasable mechanical latches includes a third latch that, when engaged, interconnects two waistband panels of the garment that connect to extend adjacent the person's torso below armpits when the garment is wrapped about the person and engaged.

35. A quick release garment, comprising:

a plurality of co-operable garment panels, which when interconnected form a garment in a configuration wrapped about at least an upper torso;

a plurality of releasable mechanical latches releasably engageable to interconnect the garment panels disposed on both left and right sides of the garment to retain the garment in said configuration, such that releasing the latches allows the garment to fall off from the upper torso; and a release arrangement including:

a manipulable member operable by hand, a plurality of latch operating members connected to the mechanical latches to release the latches, and a multiplex coupling device that connects the manipulable member to the latch operating members so that operation of the manipulable device operates the latch operating members to release the latches substantially simultaneously with each other to cause the garment to fall off the upper torso.

36. The quick release garment of claim 35, wherein the multiplex coupling device includes a slide and the plurality of latch operating members includes cables or cords attached to the slide, and wherein operation of the manipulable device moves the slide to operate the latch operating members.

37. The quick release garment of claim 35, wherein the multiplex coupling device includes a housing fastened to the garment for holding the coupling device in a fixed position relative to the garment.

* * * * *